United States Patent [19]

Brzuskiewicz

[11] 3,987,731

[45] Oct. 26, 1976

[54] COMPOSITE PROTECTIVE COATING FOR COMBUSTIBLE CARTRIDGE CASES

[75] Inventor: John Brzuskiewicz, Dolton, Ill.

[73] Assignee: The United States of America as represented by the Secretary of the Army, Washington, D.C.

[22] Filed: Jan. 16, 1976

[21] Appl. No.: 649,625

[52] U.S. Cl. ..... 102/43 R; 102/38; 102/103; 102/DIG. 1

[51] Int. Cl.[2] ..... F42B 5/04

[58] Field of Search ..... 102/38, 43 R, 43 P, 102/DIG. 1, 103

[56] References Cited

UNITED STATES PATENTS

| | | | |
|---|---|---|---|
| 3,703,868 | 11/1972 | Braak | 102/DIG. 1 |
| 3,727,512 | 4/1973 | Berger | 102/DIG. 1 X |
| 3,730,094 | 5/1973 | Quinlan | 102/43 P |
| 3,769,873 | 11/1973 | Abel | 102/DIG. 1 X |
| 3,927,616 | 12/1975 | Axelrod et al. | 102/38 X |
| 3,954,063 | 5/1976 | Kaufman et al. | 102/103 |

*Primary Examiner*—Harold Tudor

*Attorney, Agent, or Firm*—Nathan Edelberg; A. Victor Erkkila

[57] ABSTRACT

Porous combustible cartridge cases containing nitrocellulose, reinforcing fibers and a resinous binder, are rendered resistant to water and oil by coating the surface with a composite coating containing an undercoating of polyvinyl alcohol and a top coating of a copolymer of vinylidene chloride and acrylonitrile.

4 Claims, 1 Drawing Figure

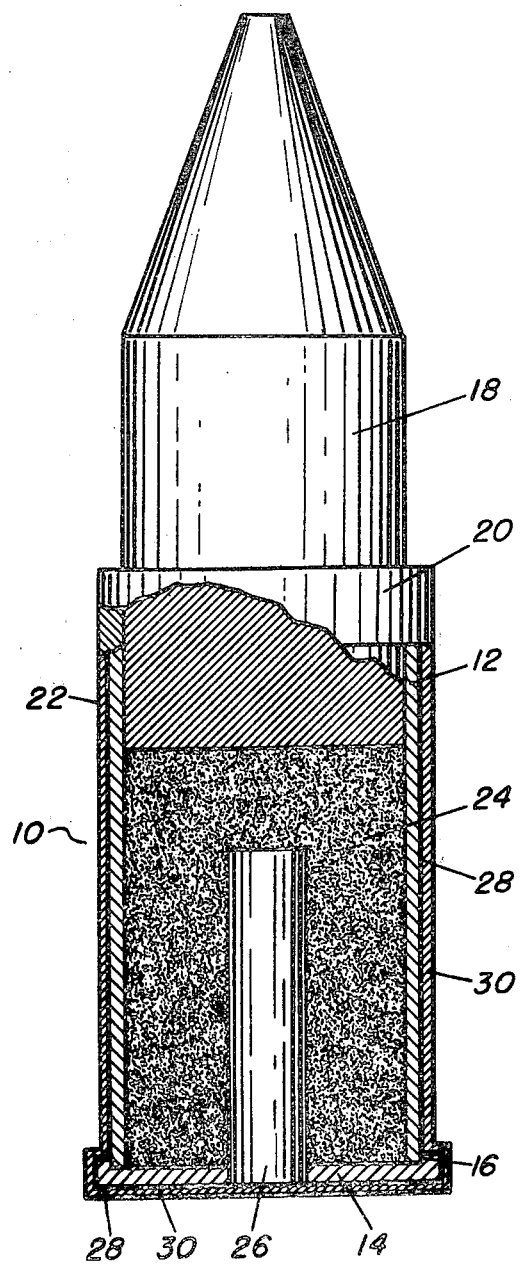
18
20
12
22
24
10
28
30
16
28
30
26
14

COMPOSITE PROTECTIVE COATING FOR COMBUSTIBLE CARTRIDGE CASES

BACKGROUND OF THE INVENTION

This invention relates to a novel combustible, non-metallic cartridge case, and particularly to a porous, fiber reinforced nitrocellulose cartridge case provided with a composite coating, which is resistant to water and oil.

Combustible cartridge cases are generally composed of nitrocellulose, reinforcing fibers, and a resinous binder. A case of such type is filled with a propellant and fitted with a primer and a projectile to form a cartridge. Compared with metallic cases, the non-metallic cartridge cases possess the dual advantages of lower weight and cost.

A common method of fabricating combustible, non-metallic cartridge cases comprises dispersing nitrocellulose fibers or powder, reinforcing fibers, such as kraft and other cellulosic fibers, and/or synthetic fibers, such as acrylics and polyesters, together with resin binders and other components, i.e., stabilizers, etc., in water and collecting the fibers on a felting die. The felted fiber form is then molded into the desired shape using appropriately shaped matched molds, cured and dried. The finished cartridge case has a porous fibrous structure, which must be maintained to ensure the rapid propagation of the flame through the case material during firing. However, due to its porous structure and content of fibers, particularly cellulosic fibers, the non-metallic cartridge case will absorb liquid water as well as permit the penetration of water vapor, which adversely affects the firing and ballistic performance of the ammunition and causes incomplete combustion of the cartridge case. In addition, contact with oily substances, such as hydraulic fluids, also degrades the combustion characteristics of such non-metallic cartridge cases.

Various attempts to overcome the aforesaid deficiencies have included coating the cartridge case surface with a plastic film, such as nitrocellulose, alkyd resins, polyethylene resins and polyvinylbutyral resins. Generally, it was found that if a coating was thick enough to protect the cartridge case against both liquid water and water vapor, the flame could not propagate throughout the case during the firing cycle with the result that the case did not burn completely and left residue in the gun. On the other hand when the amount of coating was reduced so that the coating did not interfere with the combustion of the case, the coating failed to adequately protect the case against the penetration of liquid water and water vapor, which also produced an incomplete combustion of the case with resultant residue in the gun. Such residue presents an intolerable hazard, since it can smolder and cause accidental preignition of the cartridge case of the next round loaded into the gun. In addition, absorbed water or water vapor degrades the ballistic performance of the ammunition.

An object of the present invention is to provide a coating, which will render the combustible cartridge case insensitive to water in both liquid and vapor form and oil.

Another object of the invention is to provide a combustible cartridge case whose exterior surface is provided with a coating, which renders the case substantially impermeable to water and oil, so that upon firing of the ammunition, little, if any, residue will remain in the gun due to the coating or the absorption of water or oil by said case.

The foregoing and other objects will become apparent from the following disclosure.

BRIEF DESCRIPTION OF THE DRAWING

The drawing illustrates a longitudinal cross-sectional view of a typical cartridge containing a combustible nitrocellulose cartridge case provided with a protective composite coating system according to the present invention.

SUMMARY OF THE INVENTION

In accordance with this invention, there is provided an improvement in porous combustible cartridge cases containing nitrocellulose, wherein at least the exterior surface of the case is covered with a composite or laminated coating comprising a priming or undercoating consisting essentially of a polyvinyl alcohol resin and a top coating consisting essentially of a vinylidene chloride-acrylonitrile copolymer resin.

Thermoplastic resins produced by the copolymerization of vinylidene chloride and acrylonitrile, which in this application are referred to generically as Saran resins, are characterized by excellent resistance to the transmission of water vapor and absorption of water and oils. For this reason a surface coating of such a resin on porous nitrocellulose cartridge cases would be highly desirable for providing a protective barrier against the penetration of water and oil, which has an adverse effect on the consumability of the nonmetallic cartridge case when the cartridge is fired in the gun. However, since the solvents required for dissolving Saran type resins are also powerful solvents for nitrocellulose, these resins cannot be satisfactorily applied to a nitrocellulose substrate. Such solvents migrate into the nitrocellulose cartridge case, causing (1) plasticization of the nitrocellulose and the coating, (2) drying problems, (3) reduced barrier properties and, (4) loss of porosity with resultant reduced consumability of the case during firing.

It has been found according to the present invention that the foregoing difficulties can be effectively overcome and that a porous nitrocellulose cartridge case possessing excellent consumability and resistance to penetration of water vapor, water and oils, can be obtained by applying to the nitrocellulose cartridge case a primer or undercoating of a polyvinyl alcohol (PVA) resin, which is insoluble in the solvents employed in the Saran type resin lacquer, and then applying a top coating of the said Saran type resin over said primer coating.

DETAILED DESCRIPTION OF THE INVENTION

The drawing shows an assembled cartridge, which comprises a generally cylindrical non-metallic cartridge case 10 consisting of a tubular casing 12 and a base element 14, which can be attached to the lower end of casing 12 by adhesive means 16. A metal projectile 18 provided with a rotating band 20 is mechanically or adhesively attached to the upper end 22 of casing 12. A suitable propellant 24, e.g. nitrocellulose grains, is contained in the case 10 and is ignited by a primer 26 mounted in the base element 14.

According to the present invention at least the exterior surface of the case 10 is completely coated with a composite coating consisting essentially of a primer or undercoating 28 and a top coating 30, which are more fully described and illustrated hereinafter. The nonmetallic cartridge case 10 can be obtained, for example, by mixing nitrocellulose fibers of moderate nitrogen content, reinforcing fibers, e.g. kraft or synthetic fibers such as acrylics, and a resinous binder such as polyvinyl acetate, and formed by felting, compression molding or other methods. The liquid coating compositions employed to produce the novel coating system of the present invention can be prepared in known manner and applied to the cartridge case by conventional methods, such as spraying, brushing and dipping.

The following examples illustrate specific embodiments of the present invention. In the examples the percentages reported are by weight.

EXAMPLE 1

Preparation of the Liquid Coating Compositions

| A. Polyvinyl Alcohol Primer Lacquer | |
|---|---|
| Gelvatol[R] 40–20* | 4 grams |
| Distilled water | 96 grams |

*A polyvinyl alcohol resin marketed by Shawinigan Products Corp., New York, New York.

The resin was slowly stirred into the water and the mixture was agitated until the resin was completely dissolved. A small amount (e.g. 0.5 mg.) of a water-soluble red dye was added to color the solution intensely red to facilitate visual identification of the completeness of the coating obtained therewith on the substrate.

| B. Polyvinylidene Chloride-Acrylonitrile Copolymer Lacquer | |
|---|---|
| Saran 310* | 5 grams |
| Toluene | 25 grams |
| Methyl ethyl ketone | 46 grams |
| Methyl isobutyl ketone | 14 grams |
| Butyl acetate | 10 grams |
| Total | 100 grams (5 % total solids) |

*A polyvinylidene chloride-acrylonitrile copolymer resin marketed by Dow Chemical Co., Midland, Michigan.

The Saran resin was slowly added to the solvent mixture in a ball mill jar with mild agitation to prevent agglomeration, after which the mill was rotated until the resin was completely dissolved. A trace of a blue dye (e.g. Victoria Blue) was added to provide a visual aid during the coating process.

Coating Procedure

The liquid PVA and Saran coating compositions were applied to the exterior surfaces of the casing and base of a 152 mm. porous combustible cartridge case. consisting of 8% kraft fibers
26% acrylic fibers
55% nitrocellulose (12.6%N)
10% polyvinylacetate resin binder
1% diphenylamine stabilizer The coatings were applied by a spray coating procedure using a Binks Model 15 spray gun equipped with a No. 77 fluid nozzle, No. 314 air nozzle and a size 76 needle. The air pressure to the spray gun was maintained at 30 psig. The gun was employed for applying the PVA solution as well as the Saran solution.

The cartridge casings and bases were individually mounted on a Paasche F-59 turntable (12 in. diameter and 9 in. height), which was equipped with special mounting fixtures adapted to hold the casing or base and also to mask the areas not requiring a coating. The spray gun was hand held about 1 ft. from the target and moved back and forth as the case or base was rotated to achieve complete coverage of the substrates.

The PVA wet undercoat was uniformly applied (as visually indicated by the red color of the lacquer) and allowed to air dry overnight under ambient conditions. The PVA undercoated parts were then uniformly coated with the Saran lacquer in similar manner. When multiple Saran topcoats were applied, the coatings were allowed to air dry for one week between coats, the percent addon being determined after each drying period. Slow drying of the coatings is essential to prevent tracking and cracking due to excessively rapid solvent evaporation.

Specimens of the bases coated in the foregoing manner and the uncoated bases (controls) were tested for water resistance. The test procedures and results are set forth Tables 1 and 2, which clearly show the marked decrease in water vapor transmission rates and liquid water absorption resp. obtained by means of the novel coating system of the present invention.

Table 1

Water Vapor Transmission Rates of Coated and Uncoated Cases

| Coating Weight %[1] | None | 0.8 | 1.3 | 2.3 | 0.2 | 1.4 | 2.4 |
|---|---|---|---|---|---|---|---|
| Bake[2] | — | — | — | — | + | + | + |
| WVTR[3] (g/in.[2]) | | | | | | | |
| 24 hr. | 0.40 | 0.34 | 0.10 | 0.05 | 0.10 | 0.04 | 0.02 |
| 48 hr. | | 0.51 | 0.20 | 0.10 | 0.21 | 0.08 | 0.05 |
| 72 hr. | | 0.76 | 0.29 | 0.14 | 0.31 | 0.12 | 0.07 |
| 240 hr. | | 2.50 | 0.95 | 0.48 | 1.04 | 0.38 | 0.24 |

[1]This is the total weight of the PVA-Saran composite coating added to the substrate. The PVA undercoating generally amounted to approximately 0.2 wt. %, the remainder being composed of the Saran top coat.
[2]A (+) indicates that the specimens were air dried for 3 hours and then baked for 2 hours at 150° F. A (−) indicates that the coatings were air dried only.
[3]WVTR = Water Vapor Transmission Rate, ASTM E 96–66.

Table 2

Liquid Water Absorption of Coated and Uncoated Cases

| Coating, Wt. %[1] | None | 0.9 | 1.8 | 2.5 |
|---|---|---|---|---|
| Water Absorption, wt. %[2] | | | | |
| 24 hr. | 45 | 0.37 | 0.36 | 0.17 |
| 48 hr. | — | 1.2 | 0.50 | 0.25 |

[1]See note (1) under Table 1.
[2]The coated surface of the specimen was placed under a 6 in. head of water for the periods shown.

EXAMPLE 2

152 mm. porous cartridge cases of the type described in example 1 were assembled by adhesively bonding the coated bases to the coated casings. The assembled cartridge cases thus obtained possessed an exterior composite coating of about 0.2% PVA undercoat and about 1.3% Saran 310 topcoat, based on the weight of the case. The cartridge cases were then loaded with a standard propellant and fitted with a primer and a projectile to complete the cartridge.

A number of the cartridges thus obtained were subjected to a simulated rain storm for 12 hours, totalling 8 inches of rain. The cartridges, both wet and dry, were fired from a 152 mm. cannon. The dry cartridges left no residue in the breech after firing, while the cartridges exposed to the rain left substantially no residue. Another group of the coated cartridges was subjected to 10 day cycling, during each 24 hour period of which they were exposed for 16 hours to 105° F. at 95% relative humidity and for 8 hours at 70° F. at 95% relative humidity. These cartridges left substantially no residue in the breech after firing. By contrast, cartridges made in the same manner from the same components but not provided with the aforesaid protective coating, left a substantial amount of residue in the breech, which had to be removed prior to firing the next round.

The amount of composite PVA-Saran protective coating on the cartridge case surface can be varied widely. Ordinarily, a PVA undercoat of between about 0.1 and 1% by weight and a Saran topcoat of between about 1 and 5% by weight of the cartridge case is sufficient to provide good to excellent resistance to water and oils together with excellent combustibility on firing in the cannon. The use of smaller amounts of such resins than these generally results in coatings possessing a decreased resistance to water and oils; while the use of larger amounts of such resins produces little if any further increase in resistance to water and oils, but has an increasingly adverse effect on combustibility. Optimum results are usually obtained by employing between about 0.2 and 0.5% by weight of PVA undercoat and between about 1 and 2% by weight of Saran topcoat. Further, water and water vapor resistance can be increased by incorporation of a leafing aluminum pigment (e.g. aluminum paste Alcoa 1578 marketed by the Aluminum Corp. of America) in the Saran lacquer in amounts up to about 100% or more by weight of the Saran resin. The coating solutions should be carefully applied to provide a continuous coating free from breaks, pinholes, etc., over the surface of the cartridge case.

The foregoing disclosure is merely illustrative of the principles of this invention and is not to be interpreted in a limiting sense. I wish it to be understood that I do not desire to be limited to the exact details of construction shown and described, because obvious modifications will occur to a person skilled in the art.

What is claimed is:

1. A porous combustible cartridge case comprising nitrocellulose, reinforcing fibers and a resinous binder, wherein at least the exterior surface of the case is covered with a composite protective coating comprising an undercoating consisting essentially of a polyvinyl alcohol resin and a topcoating consisting essentially of a vinylidene chloride-acrylonitrile copolymer resin.

2. The cartridge case according to claim 1, wherein the polyvinyl alcohol resin undercoating amounts to between about 0.1 and 1% by weight of the cartridge case.

3. The cartridge case according to claim 1, wherein the vinylidene chloride-acrylonitrile copolymer resin topcoating amounts to between about 1 and 5% by weight of the cartridge case.

4. The cartridge case according to claim 1, wherein the vinylidene chloride-acrylonitrile copolymer resin coating contains a leafing aluminum pigment.

* * * * *